US005145438A

United States Patent [19]

Bol

[11] Patent Number: 5,145,438

[45] Date of Patent: Sep. 8, 1992

[54] METHOD OF MANUFACTURING A PLANAR MICROELECTRONIC DEVICE

[75] Inventor: Igor I. Bol, Sherman Oaks, Calif.

[73] Assignee: Xerox Corporation, Stamford, Conn.

[21] Appl. No.: 730,322

[22] Filed: Jul. 15, 1991

[51] Int. Cl.[5] ..... H01J 9/02

[52] U.S. Cl. ..... 445/49; 445/24; 445/50; 313/308; 313/336

[58] Field of Search ..... 445/22, 24, 49, 50; 313/306, 308, 309, 336; 437/927

[56] References Cited

U.S. PATENT DOCUMENTS

| | | | |
|---|---|---|---|
| 4,855,636 | 8/1989 | Busta et al. | 313/306 |
| 4,871,687 | 10/1989 | Donzelli | 437/927 |
| 4,948,456 | 8/1990 | Schubert | 437/927 |
| 4,983,878 | 1/1991 | Lee et al. | 313/308 |

FOREIGN PATENT DOCUMENTS 0416558 3/1991 European Pat. Off. .

OTHER PUBLICATIONS

Brodie, Ivor, "Physical Considerations in Vacuum Microelectronics Devices", IEEE Transactions on Electron Devices, vol. 36, No. 11, Nov. 1989, pp. 2641-2644.

Busta, H. H., J. E. Pogemiller and M. F. Roth, "Lateral Miniaturized Vacuum Devices", IEDM, 1989, pp. 533-536.

*Primary Examiner*—Kenneth J. Ramsey

*Attorney, Agent, or Firm*—Daniel J. O'Neill

[57] ABSTRACT

A microelectronic device and a method of forming the same are disclosed. The microelectronic device includes a cathode, an anode and a first grid disposed adjacent a major surface of a substrate. The first grid is positioned between the cathode and the anode. The first grid is formed from conductive material using a sidewall spacer technique. The anode is made of conductive polysilicon, the cathode is made of tungsten and has a portion elevated from the substrate to aid in the ballistic transport of electrons. A second grid is formed using a sidewall spacer technique, and is positioned between the first grid and the anode. The method of making a microelectronic device includes forming an anode and a cathode on a surface of a substrate, then depositing, in series, first and second sacrificial layers. A first wall is formed by removing portion of the second sacrificial layer. The first wal is positioned between the anode and the cathode. A first conductive layer is deposited against the first wall and over the exposed second sacrificial layer and over exposed portions of the first sacrificial layer. A conductive sidewall spacer is formed against the first wall and between the anode and cathode by anisotropically etching the first conductive layer. The remaining portions of the first and second sacrificial layers are removed. The conductive sidewall spacer forms a first grid. A microelectronic device having a second grid is formed by the additional step of forming a second wall between the first wall and the anode.

9 Claims, 13 Drawing Sheets

METHOD OF MANUFACTURING A PLANAR MICROELECTRONIC DEVICE

CROSS-REFERENCE TO RELATED APPLICATIONS

This application contains subject matter related, in certain aspect, to the subject matter of patent application Ser. No. 07/632,870, filed Dec. 21, 1990, now U.S. Pat. No. 5,112,436, entitled, "Method of Forming Planar Vacuum Microelectronic Devices with Self Aligned Anode," by the same inventor and assigned to the same assignee herein and incorporated herein by reference.

BACKGROUND AND INFORMATION DISCLOSURE STATEMENT

This invention relates to microelectronic devices, and more particularly to a planar microelectronic triode and tetrode, and a method of fabricating the same.

A promising technology for use in high speed electronic systems is the vacuum microelectronic device, which in essence is a miniature vacuum tube that uses a cold emitter. In these microelectronic devices, electrons tunnel through a vacuum energy barrier whose width is determined by the electric field.

There are references in the art that discuss the design parameters for microelectronic devices. I. Brodie, "Physical Considerations in Vacuum Microelectronics Devices," Transactions on Electron Devices, Vol. 36, No. 11, Nov. 1989, pp. 2641–44, describes a vertical field-emission microtriode. For significant electron tunneling to take place at the tip of the emitter, the electric field at the tip must reach a relatively high strength (e.g., $1\times10^7$ V/cm). To achieve such a high electric field, the emitters are provided with a relatively sharp tip (e.g., the point of a wedge, cone or pyramid shape). The emitter is placed relatively close to the extraction electrode. The closer the gap between emitter and extraction electrode, the lower the voltage needed to produce the requisite electric field strength and the less stringent the requirement for a vacuum. For a practical microtriode device operating in a 1 torr atmosphere, the distance between the anode and cathode should be 0.5 micrometers or less.

With microtriodes, another concern is device capacitance. Device capacitance is a function of the distance between the grid and the cathode, as well as the dimensions of the grid itself. In particular, the grid should be relatively small in size to reduce device capacitance.

At present, microelectronic devices have been constructed using conventional VLSI fabrication techniques (e.g., patterning and etching). For example, H. H. Busta et al., "Lateral Miniaturized Vacuum Devices," IEDM 89, pp. 533–36, describe a planar microtriode in which the anode, grid, and cathode (referred to as collector, gate and emitter, respectively) are fabricated using successive patterning and etching steps. In particular, the dimensions of the grid are defined by patterning and etching a conductive material. Similarly, Lee et al., U.S. Pat. No. 4,983,878, issued Jan. 8, 1991, describe a vertical microtriode in which the vertical positions of anode, grid and cathode are determined by the thickness of sacrificial layers, and the dimensions of the grid are determined by etching the polysilicon material of which the grid is formed (FIGS. 6 and 14). Tsukamoto et al., EP-A-0-416-558, describes a vertical microdiode that includes a cathode (electron emission element) and an anode (electrode 3008, FIGS. 3A and 3B), with both cathode and anode being formed using patterning steps to define dimensions, and with the vertical position of the anode relative to the cathode being defined by the thickness of a layer of material (insulating layer 3006, FIG. 3B).

Generally, devices fabricated using conventional VSLI techniques perform adequately. At present, however, conventional VLSI fabrication techniques have a resolution no better than about 0.5 micrometers, with a tolerance of about 10%). Practical microelectronic devices require a closer spacing of elements than 0.5 micrometers.

One method of achieving closer spacing of microelectronic elements is discussed in a copending U.S. patent application to the same inventor, Ser. No. 07/632,870, now U.S. Pat. No. 5,112,436, entitled, "Method of Forming Planar Vacuum Microelectronic Devices," filed Dec. 21, 1990, which describes a method of manufacturing a planar microelectronic device having a self aligned anode and cathode, the anode being formed from a sidewall spacer and the distance separating the anode and cathode being determined by the thickness of a sacrificial layer between the anode and cathode.

SUMMARY OF THE INVENTION

The present invention is directed to a microelectronic device and a method of forming the same. The microelectronic device includes a cathode, an anode and a first grid disposed adjacent a major surface of a substrate. The first grid is positioned between the cathode and the anode. According to one aspect of the invention, the first grid is formed from conductive material using a sidewall spacer technique. According to other aspects of the invention, the anode is made of conductive polysilicon, the cathode is made of tungsten and has a portion elevated from the substrate to aid in the ballistic transport of electrons. According to a further aspect of the invention, a second grid is formed using a sidewall spacer technique, and is positioned between the first grid and the anode.

According to another aspect of the invention, a microelectronic device is made by forming an anode and a cathode on a surface of a substrate, then depositing, in series, first and second sacrificial layers. A first wall is formed by removing portion of the second sacrificial layer. The first wall is positioned between the anode and the cathode. A first conductive layer is deposited against the first wall and over the exposed second sacrificial layer and over exposed portions of the first sacrificial layer. A conductive sidewall spacer is formed against the first wall and between the anode and cathode by anisotropically etching the first conductive layer. The remaining portions of the first and second sacrificial layers are removed. The conductive sidewall spacer forms a first grid.

According to a final aspect of the invention, a microelectronic device having a second grid is formed by the additional step of forming a second wall between the first wall and the anode.

Other aspects of the invention will become apparent from the following description with reference to the drawings, wherein:

BRIEF DESCRIPTION OF THE DRAWINGS

FIGS. 2 through 5*a* are partial cross-sectional views of steps in fabricating the triode of FIG. 1;

DETAILED DESCRIPTION OF THE PREFERRED EMBODIMENT

Figure 1:
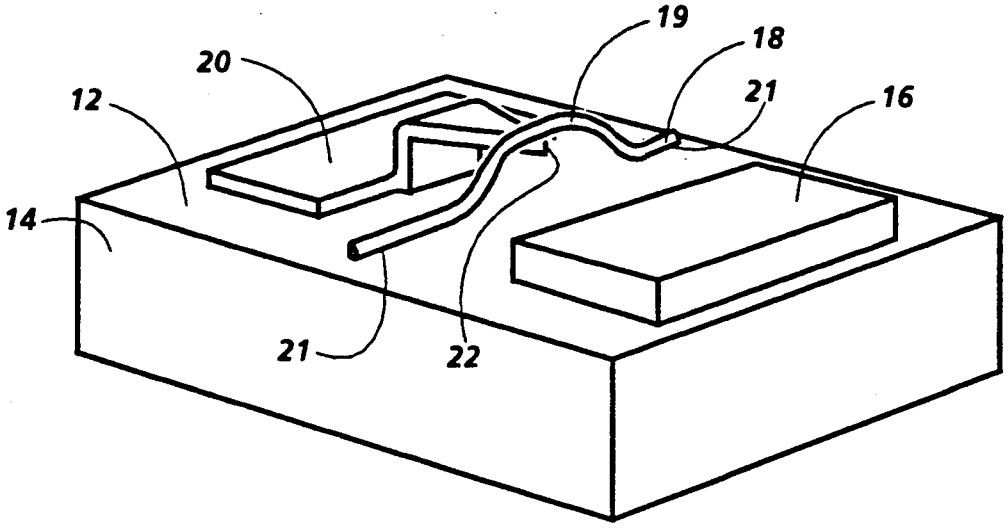
FIG. 1 is a perspective view of a microelectronic triode embodying the present invention.

Referring now to FIG. 1, there is shown a triode 10 embodying the present invention. Triode 10 is fabricated on the major surface 12 of a substrate 14. Triode 10 includes an anode 16, a grid 18 and a cathode 20 having a sharp tip 22 adjacent anode 16 for emitting electrons. Grid 18 includes an elevated portion 19 positioned between the anode 16 and cathode tip 22 for controlling the electric field at cathode tip 22. Grid 18 also includes two anchor portions 21 positioned at opposite ends of elevated grid portion 19 and attached to major surface 12 for supporting elevated grid portion 19.

Triode 10 is a field effect emitter: A positive potential applied between sharp tip 22 and grid 18 generates an electric field at tip 22. Provided the electric field at tip 22 exceed about $1\times10^7$ V/cm, electrons tunnel from tip 22 to the surrounding vacuum. Ideally, triode 10 operates in a vacuum (not shown). However, satisfactory operation of triode 10 is obtained when triode 10 is operated in a gas such that the electron mean free path for collision with residual gas molecules is much greater than the distance of the trajectory of an electron from the tip 22 of cathode 20 to anode 16. Suitable gasses include oxygen, hydrogen, helium and nitrogen. Helium is particularly desirable because of its relatively high ionization potential.

For grid 18 to satisfactorily control the electric field at tip 22, the distance from grid 18 to cathode tip 22 should be equal to or less than the length of the trajectory from tip 22 to anode 16. In addition, preferably the distance from grid 18 to cathode tip 22 is less than the distance from grid 18 to anode 16.

Figure 2:
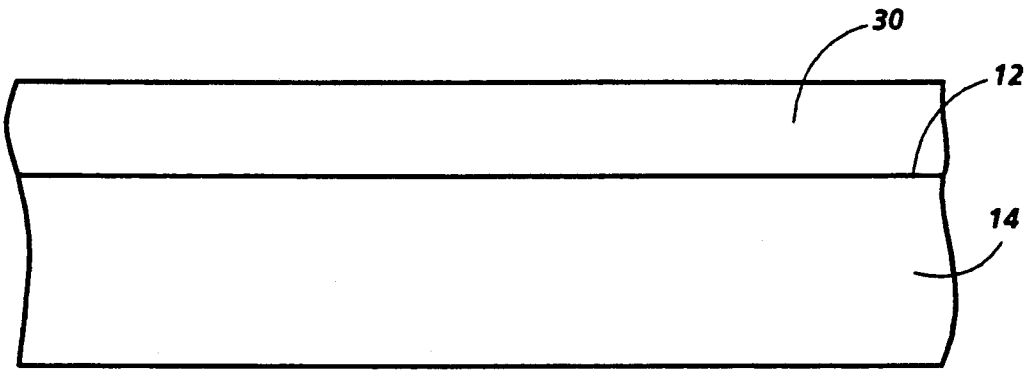
Figure 3:
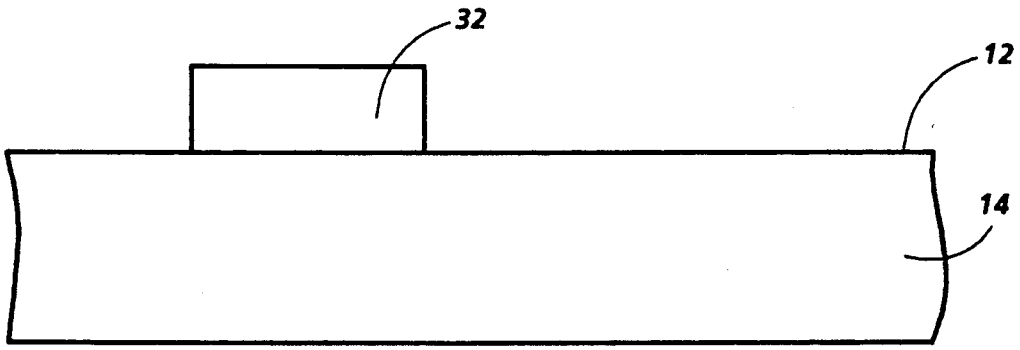
Figure 4:
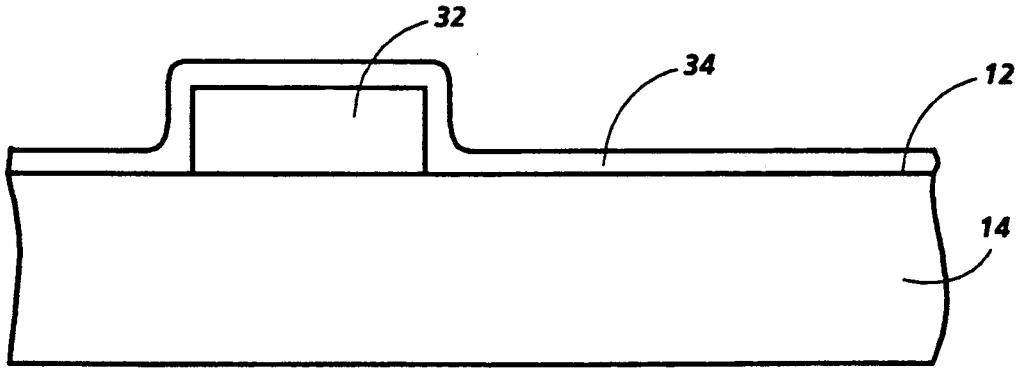

Referring now to FIGS. 2 through 16, there are shown the steps for fabricating a triode 10 according to the method of the present invention. In FIGS. 2 through 5, the cathode 20 of triode 10 is fabricated upon the major surface 12 of substrate 14. Preferably substrate 14 consists of a silicon crystal covered by an insulating layer of silicon nitride. However, substrate 14 can be made of ceramic, sapphire or any other suitable material. As shown in FIG. 2, on major surface 12 there is deposited a first sacificial layer 30. First sacrificial layer 30 preferably consists of a silicon dioxide layer about 2000 angstroms thick. As shown in FIG. 3, first sacrificial layer 30 is patterned and etched to form platform 32. Platform 32 will be used to construct an elevated portion 38 of cathode 20 above major surface 12 to aid in the ballistic transport of electrons from cathode 20.

Figure 5A:
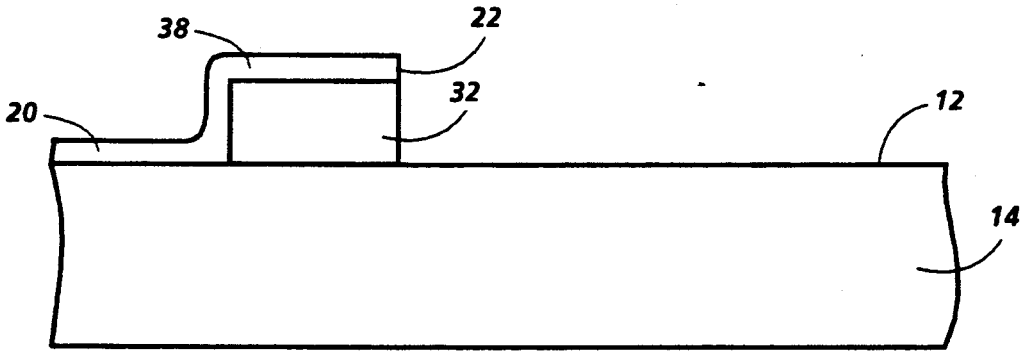
Figure 5B:
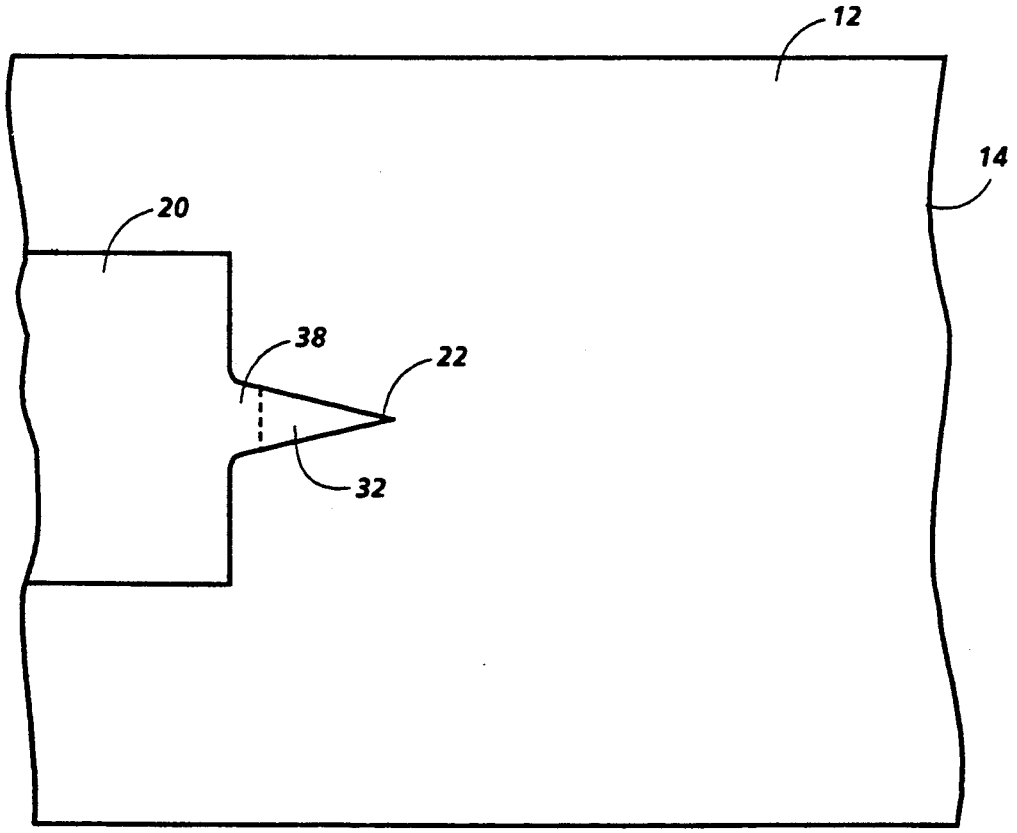
FIG. 5*b* is a top view of the step, shown in FIG. 5*a*, in fabricating the triode of FIG. 1.

A first conductive layer 34, is deposited on major surface 12, then patterned and etched to form cathode 20. A portion 38 of cathode 20 is elevated above major surface 12 by platform 32. Elevated portion 38 includes cathode tip 22. Tip 22 should be relatively sharp in order to concentrate the electric field at tip 22. For a sharp tip 22, preferably first conductive layer 30 is a relatively thin layer of tungsten, about 500 angstroms thick. Similarly, as shown in FIG. 5*b* tip 22 is shaped as a relatively sharp corner having an angle of about 30 degrees. To obtain a sharp corner, it is well known to those skilled in the art to pattern tungsten layer 34 using a double masking and etching process. In the double masking process, the same mask is used to make two patterns, with the first and second patterns offset slightly in one linear dimension, and with etching steps performed after each patterning.

Figure 6:
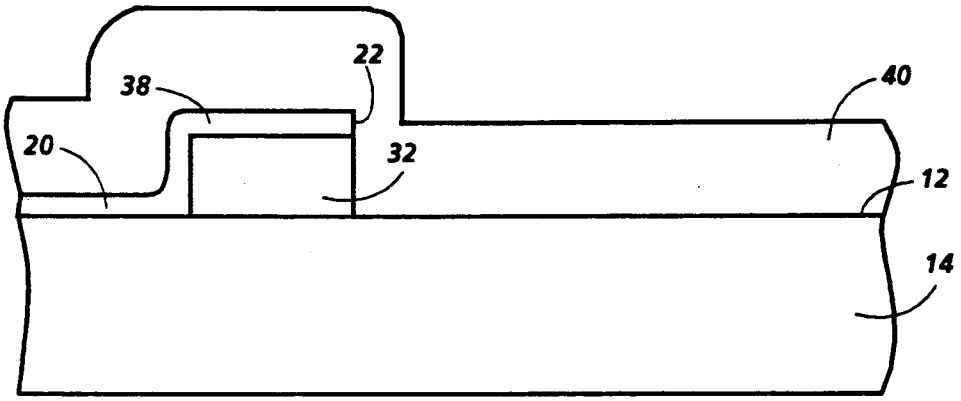
FIG. 6 is a partial cross-sectional view of a step in fabricating the triode of FIG. 1.
Figure 7A:
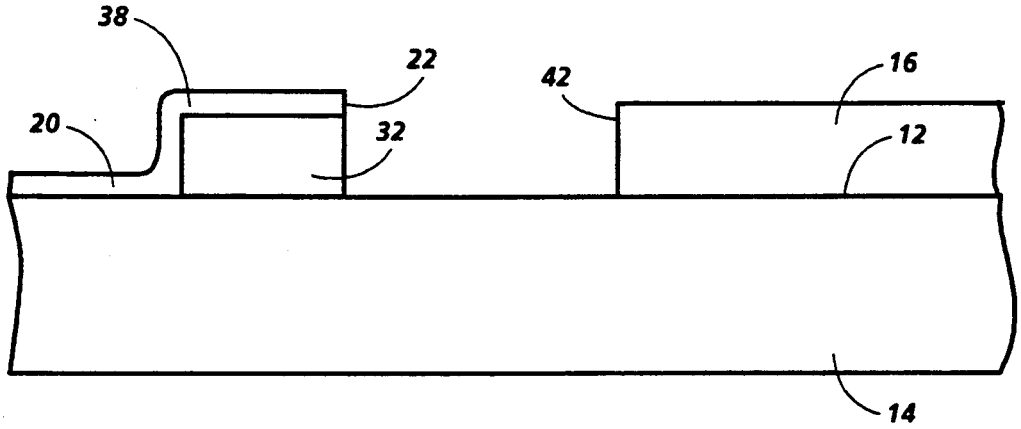
FIG. 7*a* is a partial cross-sectional view of a step in fabricating the triode of FIG. 1.
Figure 7B:
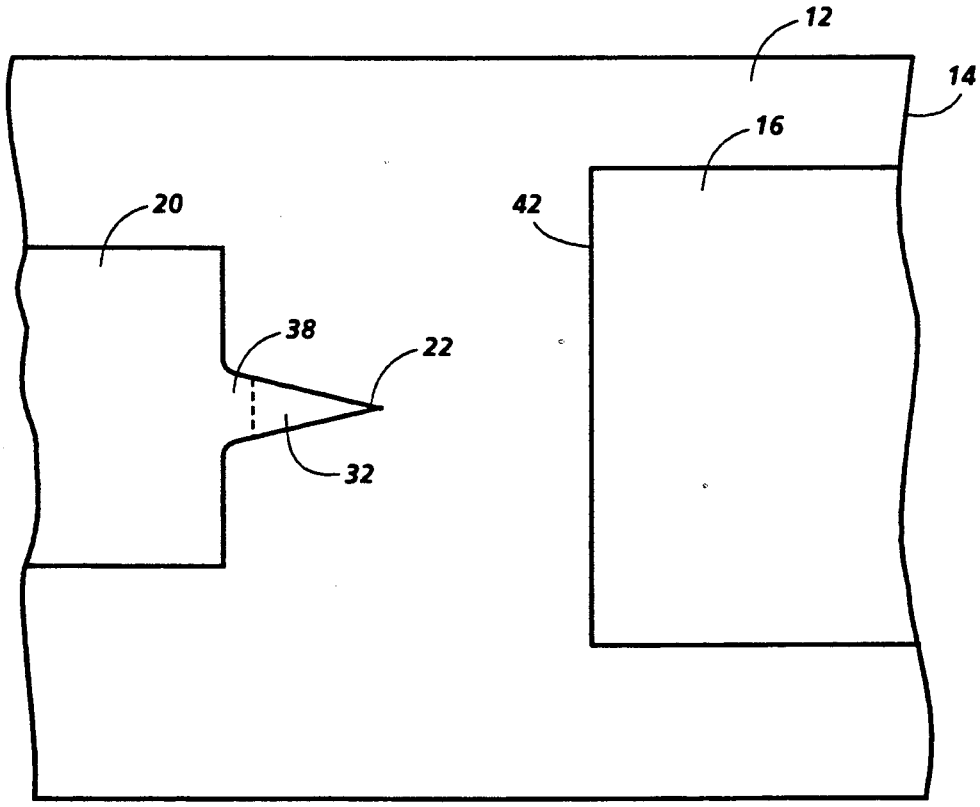
FIG. 7*b* is a top view of the step, shown in FIG. 7*a*, in fabricating the triode of FIG. 1.

Referring now to FIGS. 6, 7*a* and 7*b*, next anode 16 is fabricated. To fabricate anode 16, a second conductive layer 40 is deposited, then patterned and etched. Second conductive layer 40 preferably consists of a relatively thick 2000 angstrom thick layer of polysilicon that is subsequently doped with impurities, such as phosphorus, in a quantity sufficient to make second conductive layer 40 conductive. As shown in FIG. 7*b*, the end 42 of anode 16 opposite cathode tip 22 is rectangular in shape and is separated from tip 22 a horizontal distance of 5000 angstroms. For effective receipt of electrons from cathode 20, anode end 42 should be relatively wide compared to the distance separating anode end 42 from cathode tip 22. Preferably, the anode end 42 is at least twice the distance separating anode end 42 from cathode tip 22.

Figure 8:
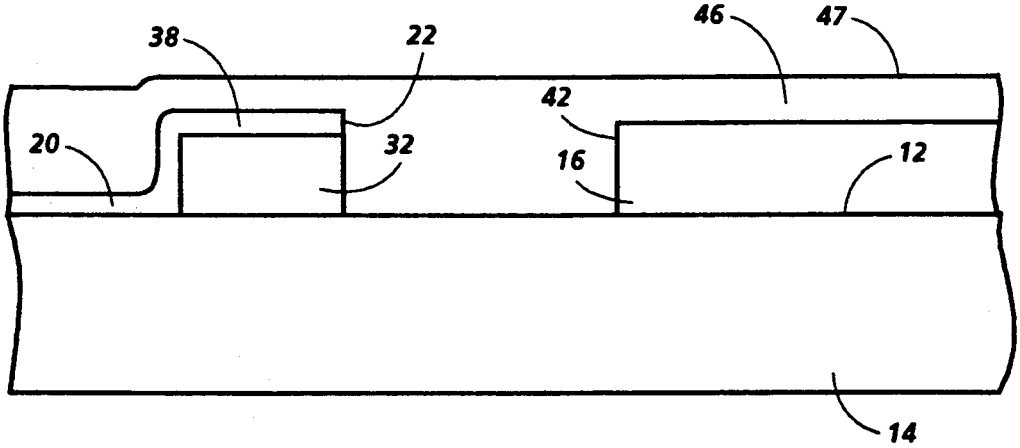
FIG. 8 is a partial cross-sectional view of a step in fabricating the triode of FIG. 1.

Referring now to FIGS. 8 through 15, next grid 18 is fabricated using a technique similar to the technique used to fabricate sidewall spacers (not shown). Lightly Doped Drain Field Effect Transistors (LDDFETs) (not shown). A sidewall spacer is a region of a material, such as silicon dioxide, that is positioned alongside a side wall of a gate structure. The sidewall spacer is used in fabricating LDDFETs to mask portions of the underlying substrate. Techniques for fabricating sidewall spacers by directional etch of vertical walls of material, such as silicon dioxide, are well known to those skilled in the art, and can be used to fabricate sidewall spacers precisely in location and dimensions. FIG. 8 shows a second sacrificial layer 46 deposited on major surface 12. Second sacrificial layer 46 should be a material that planarizes, such as photoresist or spin on glass, to avoid depressions in the top surface 47 of second sacrificial layer 46, since in depressions there could form unwanted sidewall spacers. For convenience, second sacrificial layer 46 can be made of the same material as first sacrificial layer 30, silicon dioxide, so that a subsequent etch step will wash out remaining portions of both sacrificial layers 30 and 46. The thickness of second sacrificial layer 46 will control the vertical position of grid 18 relative to cathode 20 and anode 16. Preferably second sacrificial layer 46 is a 2000 angstrom thick layer.

Figure 9:
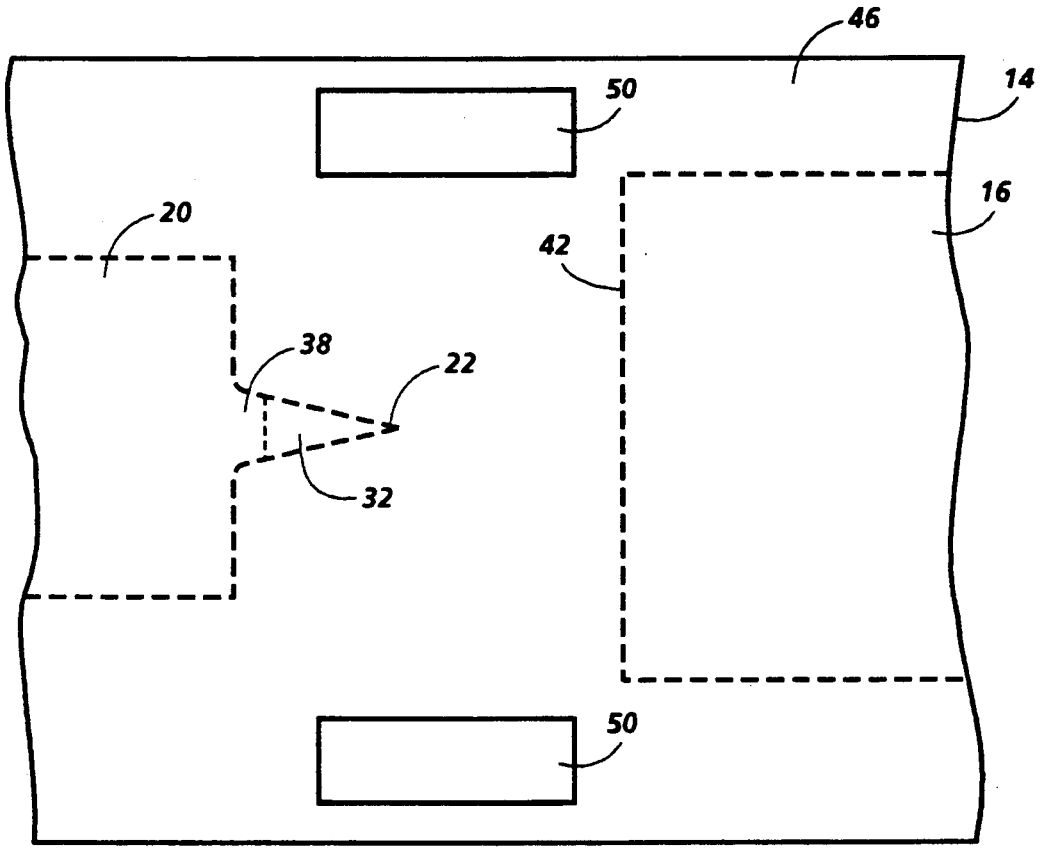
FIG. 9 is a top view of a step in fabricating the triode of FIG. 1.

Referring now to FIG. 9, second sacrificial layer 46 is patterned and etched to remove second sacificial layer 46 from regions 50 where grid anchor portions 21 will be formed.

Figure 10:
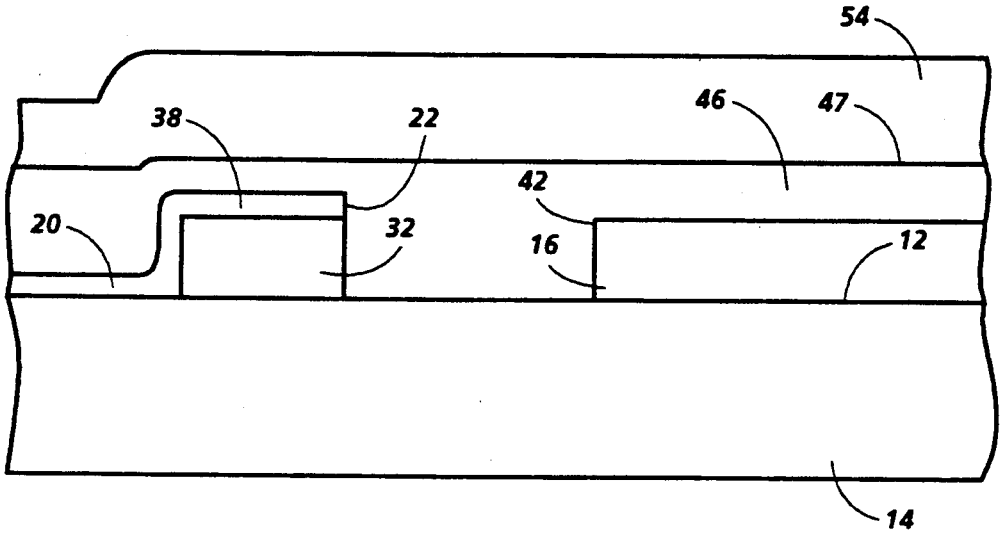
FIG. 10 is a partial cross-sectional view of a step in fabricating the triode of FIG. 1.
Figure 11A:
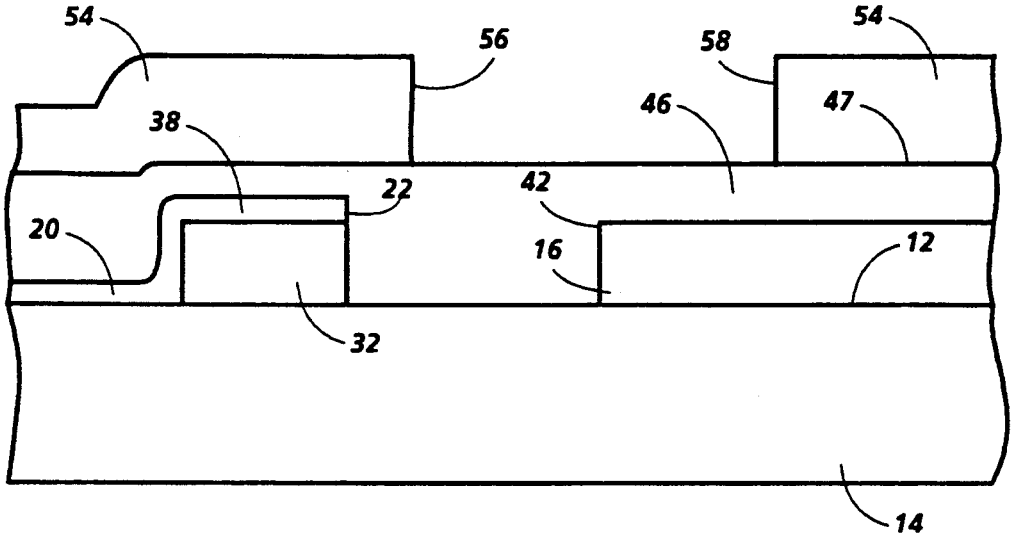
FIG. 11*a* is a partial cross-sectional view of a step in fabricating the triode of FIG. 1.
Figure 11B:
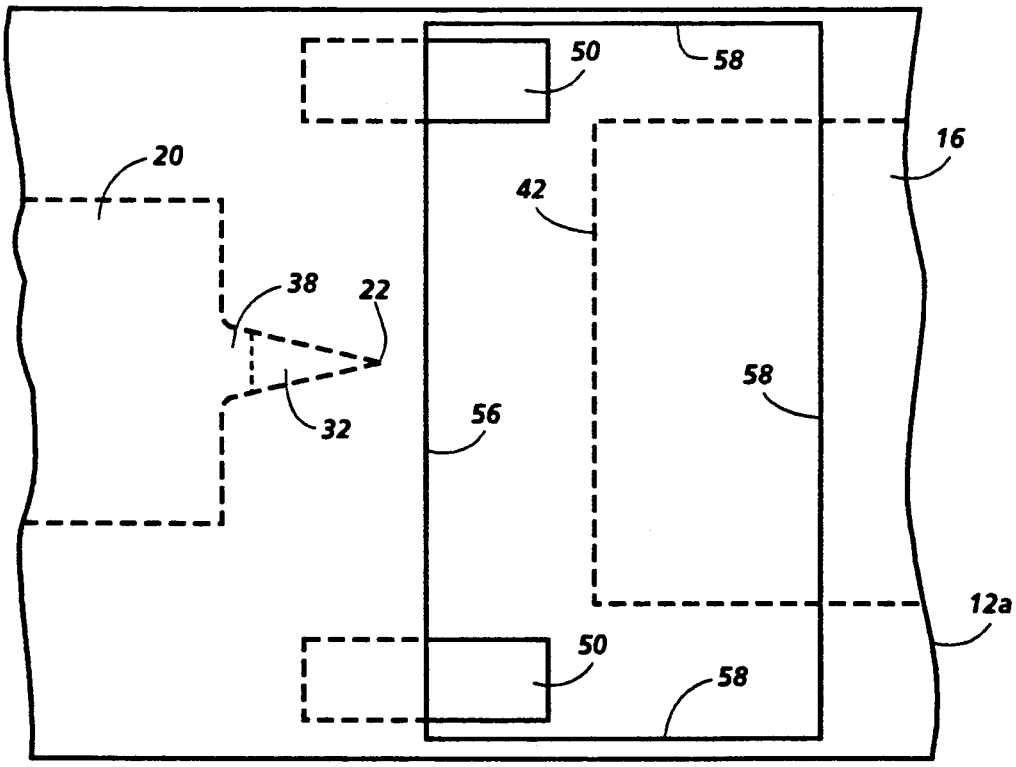
FIG. 11*b* is a top view of the step, shown in FIG. 11*a*, in fabricating the triode of FIG. 1.

Referring now to FIG. 10, third sacrificial layer 54 is deposited. Preferably third sacrificial layer 54 is a 2000 to 3000 angstrom thick layer of silicon nitride. For convenience, third sacrificial layer 54 is chosen to be a material that can be removed in a subsequent etching step without also removing first and second sacrificial layers 30 and 46. Referring now to FIGS. 11*a* and 11*b*, third sacrificial layer 54 is patterned and etched to form a relatively vertical wall 56 against which grid 18 will be formed. Wall 56 is aligned with regions 50 where grid 18 will be anchored to major surface 12. Note that the height of wall 56 depends on the thickness of third sacrificial layer 54. Similarly, of course, other vertical walls 58 are formed as well, but unlike wall 56, vertical walls 58 are not aligned with regions 50, and vertical walls 58 will later be removed.

Figure 12:
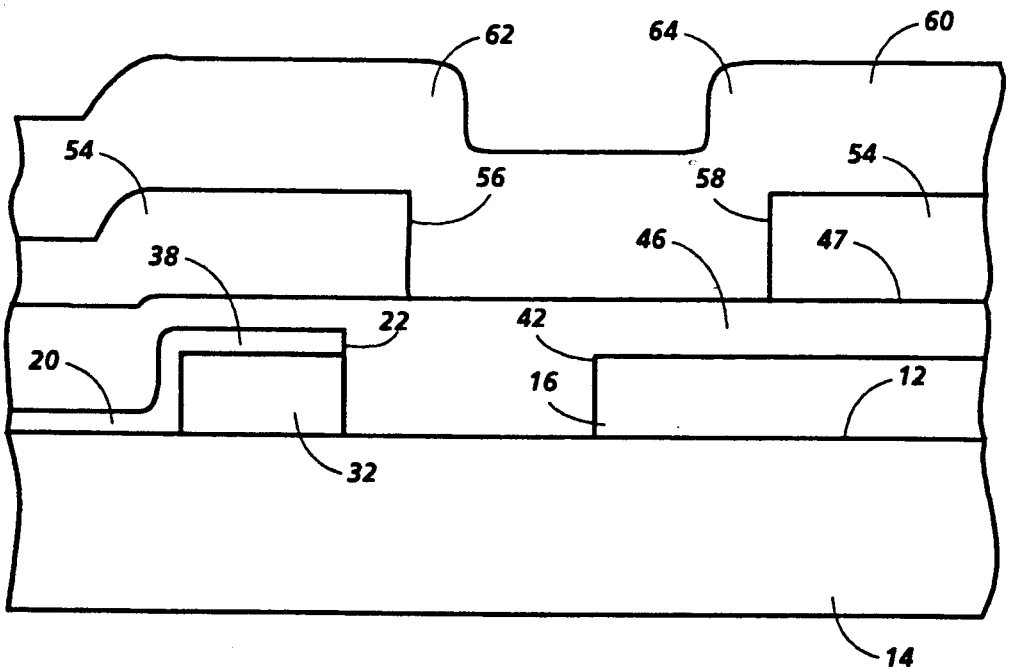
FIGS. 12 through 15 are partial cross-sectional views of steps in fabricating the triode of FIG. 1.

Referring now to FIG. 12, a third conductive layer 60 is deposited using a conformal deposition technique, such as chemical vapor deposition. Preferably, third conductive layer 60 consists of a 3000 angstrom thick layer of polysilicon that is subsequently doped with impurities, such as phosphorus, in a concentration sufficient to make it conductive. Since third conductive layer 60 was deposited conformally, there is a thicker region 62 of third conductive layer 60 alongside wall 56. Similarly, of course, alongside wall 58 there are higher regions 64 of third conductive layer 60. Third conductive layer 60 is also deposited into regions 50 where grid 18 will be anchored to major surface 12 by grid anchor portions 21.

Figure 13:
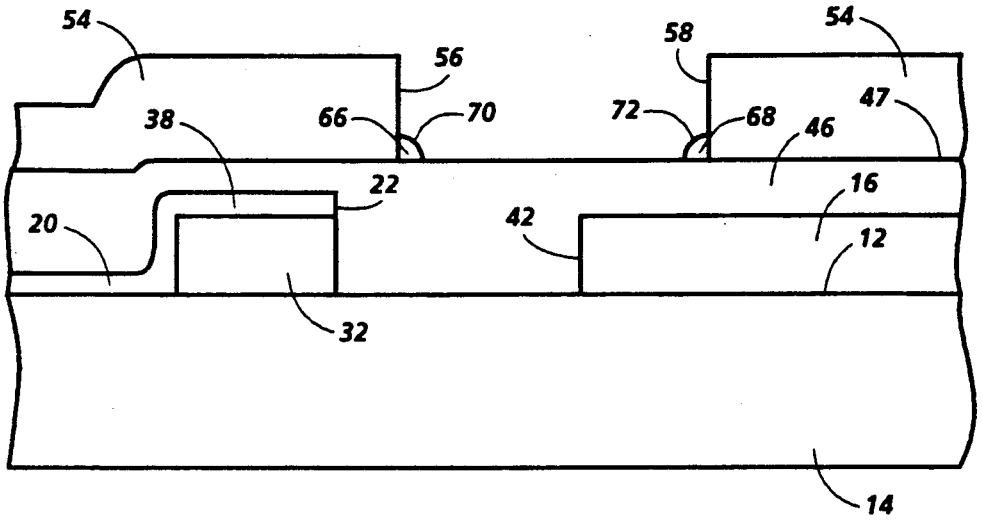

Referring now to FIGS. 12 and 13, third conductive layer 60 is etched back using an anisotropic etch to an extent sufficient to remove all of third conductive layer 60 except for portions of thicker regions 62 and 64. In this manner a conductive sidewall spacer 66 is formed alongside wall 56. The anisotropic etch rounds the side 70 of spacer 66 exterior to wall 56 because side 70 is not shielded from the etch by wall 56. Similarly, sidewall spacers 68 are formed alongside walls 58 and the anisotropic etch rounds the sides 72 of spacers 68 exterior to walls 58.

Figure 14:
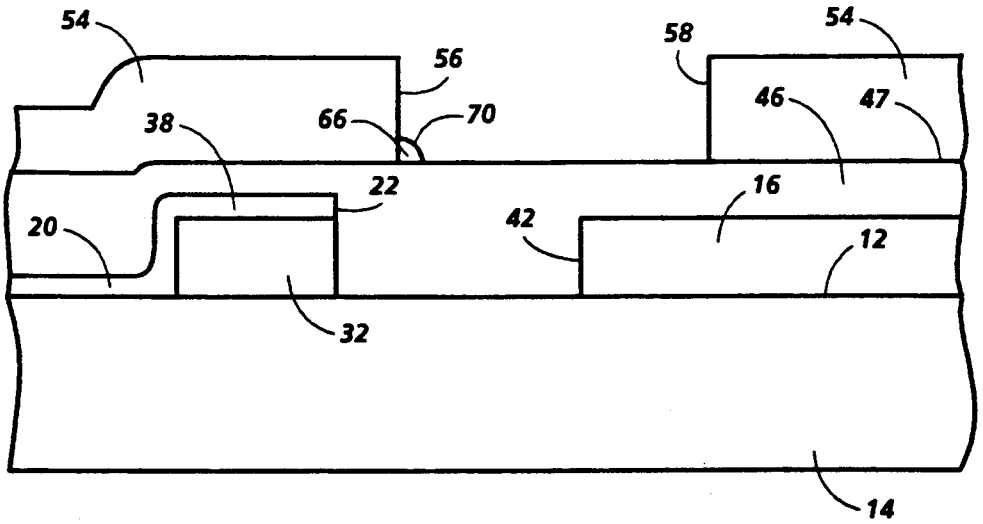
Figure 15:
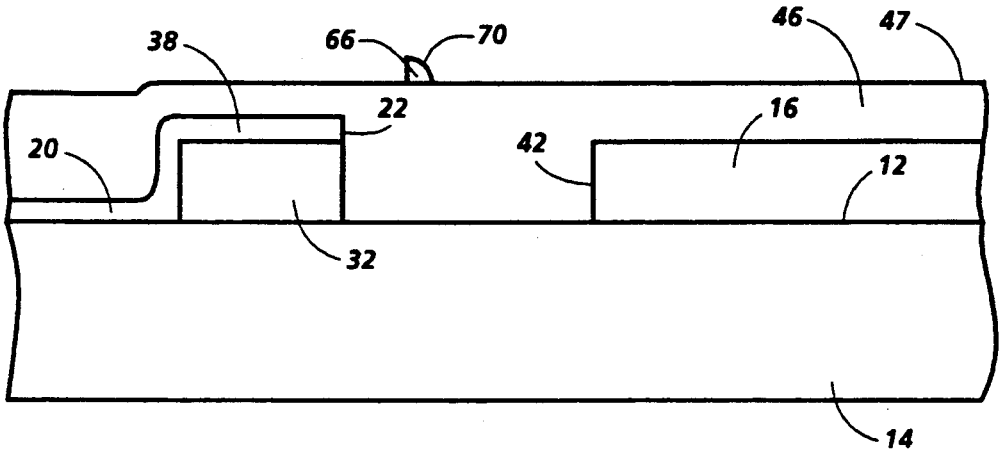
Figure 16C:
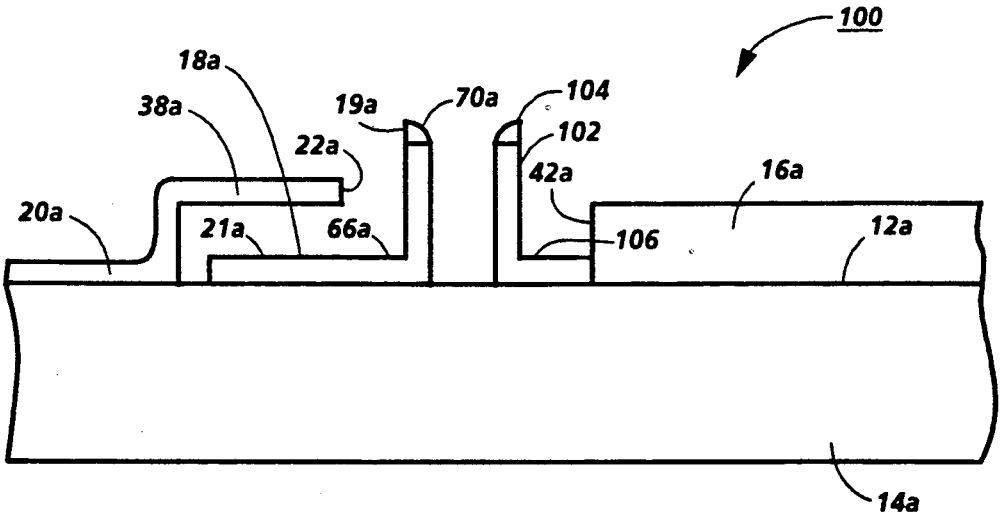
FIG. 16*c* is a partial cross-sectional view of a microelectronic tetrode embodying the present invention.
Figure 16A:
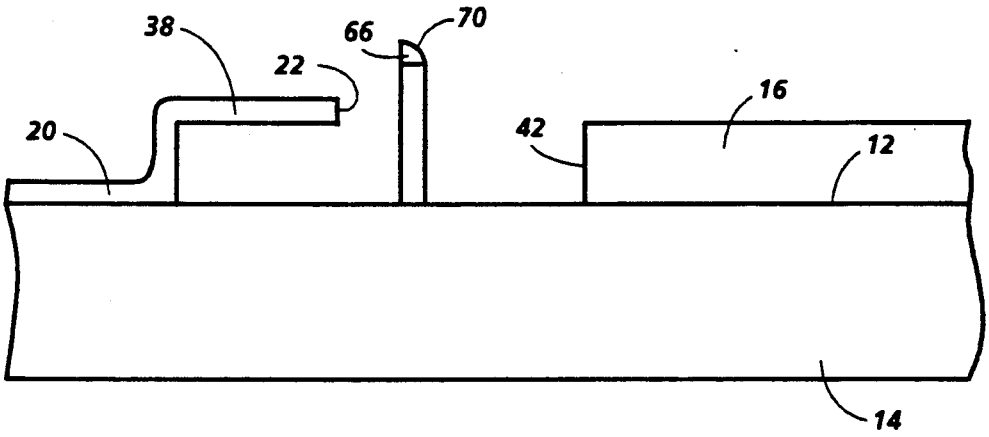
FIG. 16*a* is a partial cross-sectional view of the triode of FIG. 1.
Figure 16B:
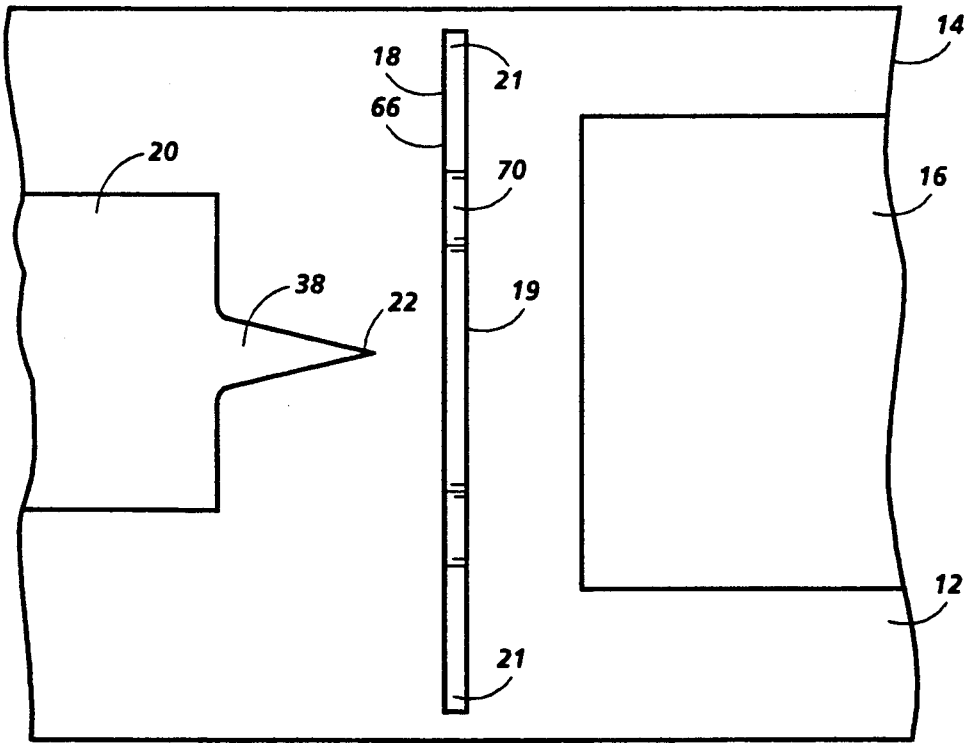
FIG. 16*b* is a top view of the triode of FIG. 1.

Referring now to FIG. 14, unwanted sidewall spacers 68 are now removed using a conventional patterning and etching step. Referring now to FIGS. 15, 9 and 11*b*, the remaining portions of third sacrificial layer 54 are removed by an etching process, then a fourth conductive layer (not shown), such as aluminum, is deposited, patterned and etched to form interconnects (not shown) to grid 18, cathode 20 and anode 16. Referring now to FIGS. 15, 16*a* and 16*b*, the remaining portions of second sacrificial layer 46 and first sacrificial layer 30, including platform 32, are removed by an etching process, leaving conductive sidewall spacer 66 to form grid 18.

There are two significant advantages to using the sidewall spacer technique to form grid 18 rather than forming grid 18 using conventional VLSI techniques. Both advantages derive from the smaller, readily reproducible grid cross section possible from the sidewall spacer technique. First, the smaller grid cross section minimizes the capacitance of triode 10. Second, the smaller grid cross section minimizes the distance between cathode tip 22 and anode end 42. Both of these advantages maximize the speed of triode 10.

Figure 16D:
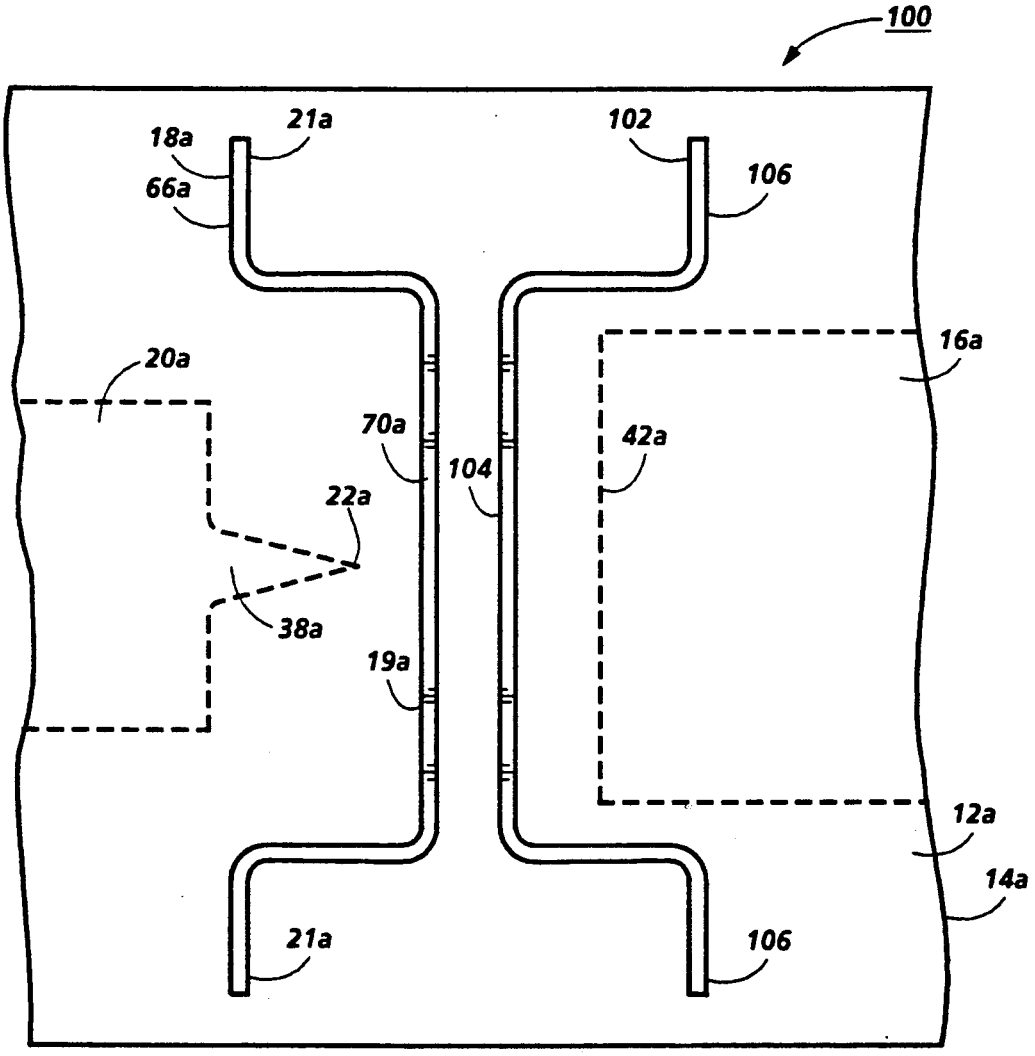
FIG. 16*d* is a top view of the tetrode of FIG. 16*c*.

The above technique is not limited to forming a triode 10 having a single grid 18, but could be used to form multiple grid microelectronic devices. For example, FIGS. 16*c* and 16*d* show a microelectronic device, a tetrode 100, having a second grid 102. In FIGS. 11*c*, 11*d*, 16*c* and 16*d* and accompanying text, elements of tetrode 100 corresponding to elements of triode 10 are labeled and referred to using the same numerals, except that the designations of corresponding tetrode elements include the letter a added to the numerals as a suffix (e.g., grid 18 in FIG. 16*a* becomes grid 18*a* in FIG. 16*c*).

Referring now to FIGS. 16*c* and 16*d*, second grid 102 is positioned between grid 18*a* and end 42*a* of anode 16*a*. Second grid 102 includes an elevated portion 104 positioned between the elevated portion 19*a* of first grid 18*a* and anode end 42*a*, and anchor portions 106 located at opposite ends of elevated portion 104 for attaching second grid 102 to major surface 12*a*.

Figure 11C:
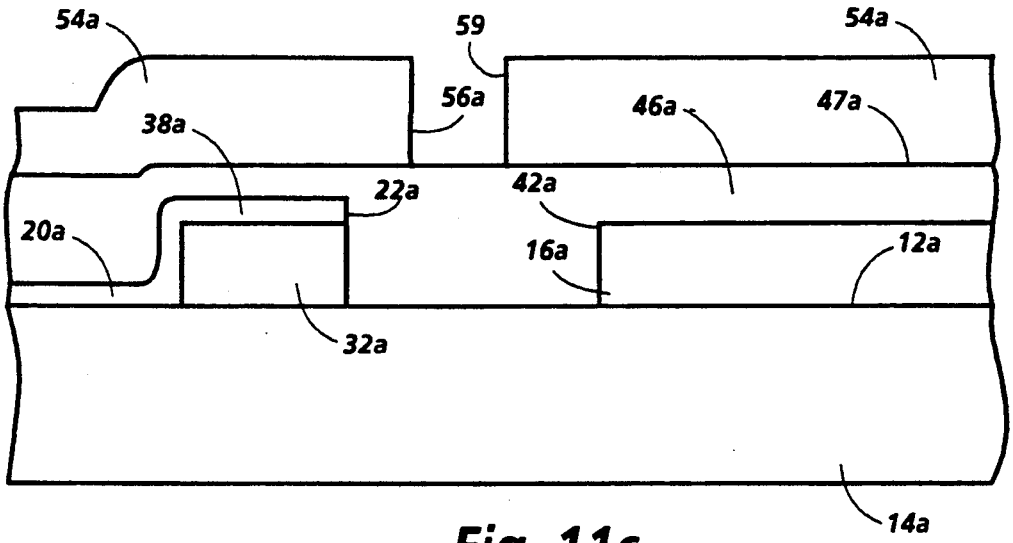
FIG. 11*c* is a partial cross-sectional view of an alternative step to the step shown in FIG. 11*a* that is used for fabricating the tetrode of FIGS. 16*c* and 16*d*.

Second grid 102 is fabricated in the same manner that grid 18*a* is fabricated. Referring now to FIGS. 11*a*, 11*b*, 11*c*, 11*d*, and 13, second grid 102 is fabricated using one of the unwanted conductive sidewall spacers 68 (shown in FIG. 13). To this end, as shown in FIG. 11*c* a wall 59 (corresponding to a wall 58 in FIG. 11*a*) is positioned between wall 56*a* and anode end 42*a*.

Figure 11D:
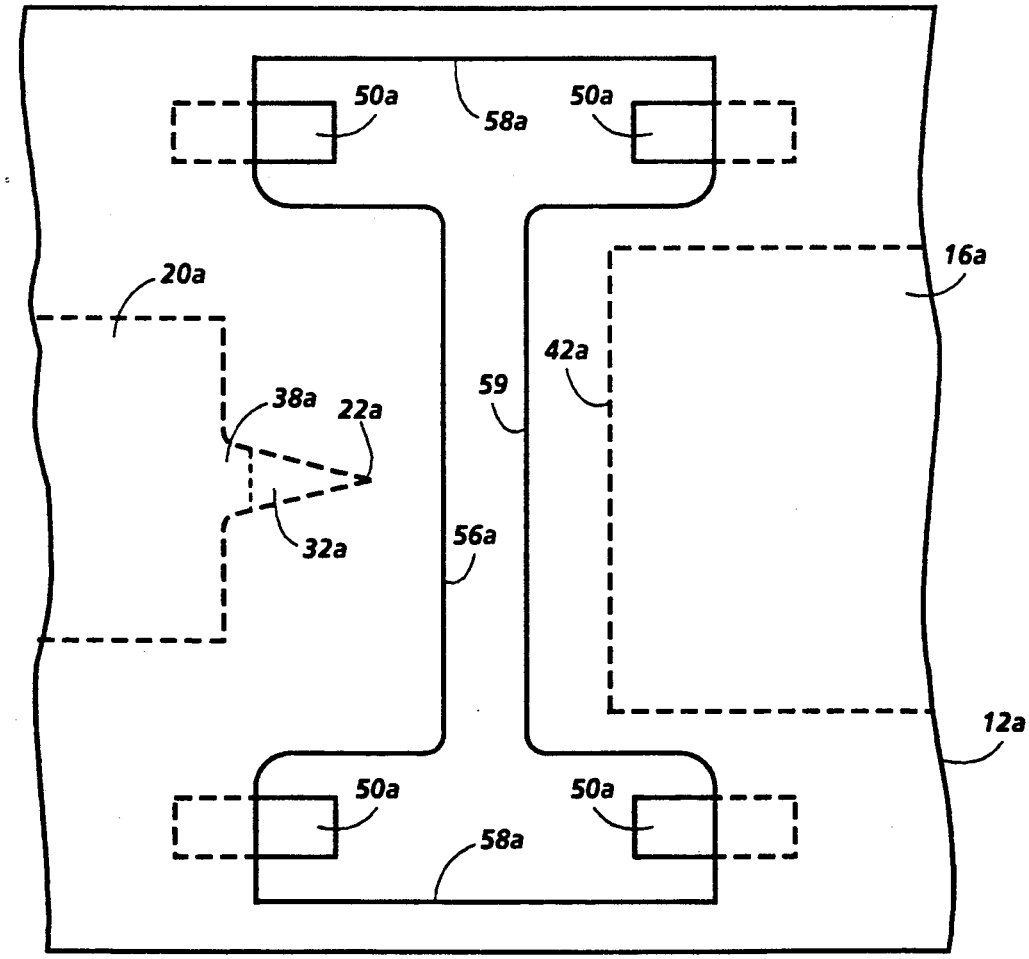
FIG. 11*d* is a top view of the step, shown in FIG. 11*c*, in fabricating the tetrode of FIGS. 16*c* and 16*d*.

Referring now to FIGS. 11*c* and 11*d*, it is important to note that walls 56*a* and 59, which define the positions of respective grids 18*a* and 102, may be formed simultaneously by a single line patterned between cathode tip 22*a* and anode end 42*a*. In contrast, forming two grids using conventional VLSI techniques would require patterning two lines between cathode tip 22*a* and anode end 42*a*, and hence would require more space between cathode tip 22*a* and anode end 42*a*.

Since tetrode 100 has two grids 18*a* and 102, preferably the grids 18*a* and 102 are anchored to major surface 12*a* by anchor portions 21*a* and 106, respectively, such that the grids 18*a* and 102 can be interconnected separately. In particular, associated with each wall 56*a* and 59 are separate pairs of anchor regions 50*a*. At anchor regions 50*a*, the spacing between walls 56*a* and 59 is greater than the spacing between walls 56*a* and 59 in the vicinity of cathode tip 22*a* and anode end 42*a*. The greater spacing of walls 56*a* and 59 produces a greater spacing of grids 18*a* and 102 to allow for attaching separate interconnects (not shown).

In the above-described embodiments, only a single triode 10 or tetrode 100 is described. However, many such devices could be formed simultaneously on a single substrate.

In the above-described embodiments, devices 10 and 100 operate in a vacuum or partial vacuum, and the emission of electrons from cathodes 20 and 20*a* is field induced. Alternatively, devices 10 and 100 could operated in a gas filled environment such that although the initial emission of electrons would be field induced, this emission would give rise to a gas discharge within devices 10 and 100.

While the invention has been described with reference to the structures disclosed, it is not confined to the specific details set forth, but is intended to cover such modifications or changes as may come within the scope of the claims.

What is claimed is:

1. A method of fabricating a microelectronic device, comprising the steps of:

(a) forming a cathode and an anode on a surface of a substrate;

(b) forming a first sacrificial layer over the substrate, cathode and anode;

(c) forming a second sacrificial layer over the first sacrificial layer;

(d) removing a portion of the second sacrificial layer to expose a part of said first sacrificial layer and form a wall positioned between the cathode and the anode;

(e) forming a first conductive layer against the wall and over the second second sacrificial layer and the exposed portions of the first sacrificial layer; and (f) forming a conductive sidewall spacer against the wall by anisotropically etching the first conductive layer.

2. The method of claim 1, further including the step of:

(g) removing the remaining portions of the first and second sacrificial layers.

3. The method of claim 1, wherein in step (b) forming a first sacrificial layer comprises depositing silicon dioxide.

4. The method of claim 1, wherein in step (b) forming a first sacrificial layer comprises depositing about a 2000 angstrom thick layer of material.

5. The method of claim 1, wherein in step (c) forming a second sacrificial layer comprises depositing silicon dioxide.

6. The method of claim 1, wherein in step (c) forming a second sacrificial layer comprises depositing about a 2000 angstrom thick layer of material.

7. The method of claim 1, wherein in step (b) the first sacrificial layer includes a relatively planar surface and in step (c) the second sacrificial layer is formed over the relatively planar surface of the first sacrificial layer.

8. The method of claim 1, wherein in step (e) forming a first conductive layer comprises deposition a relatively conformal conductive layer.

9. A method of fabricating a microelectronic device, comprising the steps of:

(a) forming a cathode and an anode on a surface of a substrate;

(b) forming a first sacrificial layer over the substrate, cathode and anode;

(c) forming a second sacrificial layer over the first sacrificial layer;

(d) removing a portion of the second sacrificial layer to expose a part of said first sacrificial layer and form a first wall positioned between the cathode and the anode and removing a portion of the second sacrificial layer to form a second wall positioned between the first wall and the anode;

(e) forming a first conductive layer against the first wall and the second wall and over the second sacrificial layer and the exposed portions of the first sacrificial layer; and (f) forming a first conductive sidewall spacer against the first wall and a second conductive sidewall spacer against the second wall by anisotropically etching the first conductive layer.

* * * * *